US010236589B2

(12) United States Patent
Legay

(10) Patent No.: US 10,236,589 B2
(45) Date of Patent: Mar. 19, 2019

(54) ACTIVE ANTENNA ARCHITECTURE WITH RECONFIGURABLE HYBRID BEAMFORMING

(71) Applicant: THALES, Courbevoie (FR)

(72) Inventor: Hervé Legay, Plaisance du Touch (FR)

(73) Assignee: THALES, Courbevoie (FR)

( * ) Notice: Subject to any disclaimer, the term of this patent is extended or adjusted under 35 U.S.C. 154(b) by 306 days.

(21) Appl. No.: 15/355,968

(22) Filed: Nov. 18, 2016

(65) Prior Publication Data

US 2017/0162943 A1 Jun. 8, 2017

(30) Foreign Application Priority Data

Dec. 4, 2015 (FR) ..... 15 02522

(51) Int. Cl.

| | |
|---|---|
| ***H01Q 15/00*** | (2006.01) |
| ***H01Q 25/00*** | (2006.01) |
| ***H01Q 1/42*** | (2006.01) |
| ***H01Q 19/13*** | (2006.01) |
| ***H01Q 21/00*** | (2006.01) |
| ***H01Q 1/28*** | (2006.01) |
| ***H01Q 15/02*** | (2006.01) |

(52) U.S. Cl.

CPC ..... *H01Q 15/0033* (2013.01); *H01Q 1/288* (2013.01); *H01Q 1/42* (2013.01); *H01Q 1/422* (2013.01); *H01Q 15/0026* (2013.01); *H01Q 15/02* (2013.01); *H01Q 19/138* (2013.01); *H01Q 21/0031* (2013.01); *H01Q 25/008* (2013.01)

(58) Field of Classification Search

CPC ..... H01Q 1/288; H01Q 1/42; H01Q 1/422; H01Q 3/2676; H01Q 3/2682; H01Q 3/22; H01Q 3/26; H01Q 3/32; H01Q 15/0026; H01Q 15/02; H01Q 19/138; H01Q 21/0031; H01Q 15/0033; H01Q 25/008

USPC ..... 342/375

See application file for complete search history.

(56) References Cited

U.S. PATENT DOCUMENTS

| | | | | |
|---|---|---|---|---|
| 3,170,158 A | | 2/1965 | Rotman | |
| 3,979,754 A | | 9/1976 | Archer | |
| 5,162,803 A | * | 11/1992 | Chen | H01Q 3/22 342/372 |
| 5,936,588 A | | 8/1999 | Rao et al. | |

(Continued)

FOREIGN PATENT DOCUMENTS

EP 1148583 A1 * 10/2001 ..... H01Q 1/525

*Primary Examiner* — Harry K Liu

(74) *Attorney, Agent, or Firm* — Baker & Hostetler LLP

(57) ABSTRACT

An antenna architecture comprises a hybrid beamformer comprising on the one hand, Ny stacked quasi-optical beamformers, each quasi-optical beamformer comprising a parallel-plate waveguide furnished with a linear radiating aperture and integrating a lens and internal horns furnished with beam access ports, each quasi-optical beamformer forming beams in two, transmission and reception, frequency bands, in a first direction in space, and on the other hand, at least one electronic beamformer comprising a combining device linked to Nx phase and amplitude control chains, each phase and amplitude control chain being connected to a respective beam access port of each quasi-optical beamformer, the electronic beamformer forming beams in a second direction in space, orthogonal to the first direction.

11 Claims, 11 Drawing Sheets

(56) References Cited

U.S. PATENT DOCUMENTS

| | | | | |
|---|---|---|---|---|
| 6,275,184 | B1 | 8/2001 | Hemmi et al. | |
| 2010/0060521 | A1* | 3/2010 | Hayes | H01Q 1/38<br>342/368 |
| 2010/0207833 | A1* | 8/2010 | Toso | H01Q 3/46<br>343/754 |

* cited by examiner

ACTIVE ANTENNA ARCHITECTURE WITH RECONFIGURABLE HYBRID BEAMFORMING

CROSS-REFERENCE TO RELATED APPLICATIONS

This application claims priority to foreign French patent application No. FR 1502522, filed on Dec. 4, 2015, the disclosure of which is incorporated by reference in its entirety.

FIELD OF THE INVENTION

The present invention relates to an active antenna architecture with reconfigurable hybrid beamforming. The antenna can be applied to the terrestrial or space field and notably in the field of satellite telecommunications. It can in particular be mounted on a terrestrial terminal or aboard a satellite.

To facilitate the description, the mode of operation of the beamformers is assumed to be reception, but a similar description could be formulated for transmission.

BACKGROUND

A reconfigurable active antenna with electronic beamforming comprises several radiating elements, active chains intended to process the signals received by the radiating elements, and a beamformer which recombines the signals received, in a coherent manner, in various directions to form various beams. Each radiating element is connected to the beamformer by way of a dedicated active chain. When the beamforming is carried out on microwave-frequency signals, the processings carried out by each active chain comprise a filtering and an amplification of the received signals. When the beamforming is carried out on analogue signals transposed to baseband, the processings carried out by each active chain furthermore comprise a frequency transposition. The processings can also comprise digitization if the beamforming is carried out on digitized signals.

Conventionally, as represented in the example of FIG. 1, a radiofrequency planar beamformer divides the signals received by each radiating element E1, E2, . . . , Ei, . . . , EN, into M sub-signals which are conveyed in M different channels, and then applies a phase shift and an attenuation of controllable value to each of the M sub-signals, before recombining the sub-signals originating from the N radiating elements so as to form M different beams S1, S2, . . . , SM, also called spots. However, the radiofrequency planar beamformer makes it necessary to produce crossovers between the channels conveying the sub-signals, the number of crossovers being equal to the product of the number M of beams times the number N of radiating elements. Consequently, the more significant the number of beams to be produced, the more the mass, the bulk and the complexity of this beamformer increases. This beamformer therefore quickly becomes unachievable when it is necessary to produce a large number of beams to cover a wide angular sector.

When the beamforming is carried out on analogue signals transposed to baseband, the crossovers are easier to produce by using ASICs. This makes it possible to limit the mass and the bulk of the beamformer, but this technology entails too significant a power consumption.

When the beamforming is carried out on digital signals, the digitization of the signals on a large number of radiating elements generally leads to significant consumed powers.

According to another technology, planar quasi-optical beamformers exist which use electromagnetic propagation of the radiofrequency waves originating from several feed sources placed at input, for example internal horns, according to a mode of propagation, in general TEM (Transverse Electric Magnetic), between two parallel metal plates. The focusing and the collimation of the beams can be carried out by a lens, for example an optical lens as described notably in documents U.S. Pat. No. 3,170,158 and U.S. Pat. No. 5,936,588 which illustrate the case of a Rotman lens, the lens being inserted in the propagation path of the radiofrequency waves, between the two parallel metal plates. Various types of lenses can be used, these lenses serving essentially as phase correctors and making it possible in most cases to convert a, or several, cylindrical wave transmitted by the sources into a, or several, plane wave propagating in the waveguide with parallel metal plates. The lens can comprise two opposite edges with parabolic profiles, respectively input and output. Alternatively, the lens can be a dielectric lens, or an index-gradient lens, or any other type of lens. As this technology uses parallel-plate waveguides, as alternative to the use of several discrete radiating elements aligned side by side, it is possible to use a continuous radiating linear aperture at the output of each parallel-plate waveguide. These radiating linear apertures, which are not spatially quantized, have much higher performance relative to linear arrays of several radiating elements, for squinted beams, because of the absence of quantization, and in terms of bandwidth because of the absence of resonant propagation modes.

A quasi-optical beamformer is much simpler to produce than traditional beamformers with individual waveguides since it comprises neither coupler, nor crossover device and makes it possible to produce several beams which cover a wide angular sector, without any aberration. Furthermore, their bandwidth is very significant and they can operate both in a transmission band Rx and in a reception band Tx. However, the known planar beamformers are capable of forming beams only according to a single dimension in space, in a direction parallel to the plane of the metal plates. To form beams along two dimensions in space, in two directions, respectively parallel and orthogonal to the plane of the metal plates, it is necessary to orthogonally combine together two beamforming assemblies, each beamforming assembly consisting of a stack of several layers of unidirectional beamformers. To orthogonally combine two beamforming assemblies, it is furthermore necessary to design connection interfaces, in particular input/output connectors, on each beamforming assembly and then to link the various corresponding inputs and outputs of the two beamforming assemblies pairwise by dedicated interconnection cables, as is represented for example in document U.S. Pat. No. 5,936,588 for lens-based beamformers. This architecture is satisfactory for forming a small number of beams, but becomes very complex and overly bulky when the number of beams increases.

No planar beamforming device exists which makes it possible to form beams along two dimensions in space. Moreover, neither do any simple solutions exist for interconnecting two unidirectional beamformers making it possible to dispense with the connection interfaces and interconnection cables.

SUMMARY OF THE INVENTION

The aim of the invention is to produce a novel reconfigurable active antenna architecture comprising a simpler electronic beamformer than the known electronic beamformers, making it possible to reduce the number of signals to be controlled in terms of phase and amplitude, to reduce the number of signals to be recombined electronically for each beam, and to produce a large number of beams on the basis of a large number of radiating elements.

Accordingly, the invention relates to an active antenna architecture with reconfigurable beamforming, comprising a hybrid beamformer consisting, of Ny stacked planar quasi-optical beamformers, where Ny is an integer number greater than one, each quasi-optical beamformer comprising a parallel-plate waveguide having two ends respectively furnished with a linear radiating aperture and with My beam access ports, a lens integrated into the parallel-plate waveguide, internal horns distributed periodically side by side along a focal axis of the lens, the beam access ports being respectively associated with the internal horns, each quasi-optical beamformer forming beams in two separate frequency bands, respectively for transmission and for reception, in a first direction in space parallel to the plane of the parallel-plate waveguides, and of at least one planar electronic beamformer comprising Ny phase and amplitude control chains and a combining device comprising Ny inputs respectively linked to the Ny phase and amplitude control chains and at least one beam output, each phase and amplitude control chain being connected to a respective beam access port of each quasi-optical beamformer, the electronic beamformer forming beams in a second direction in space, orthogonal to the first direction.

Advantageously, the antenna architecture can furthermore comprise switches able to select, in each quasi-optical beamformer, a port from among all the available beam access ports, each switch comprising an input connected to a phase and amplitude control chain of the electronic beamformer and several outputs respectively connected to several respective beam access ports of the corresponding quasi-optical beamformer.

Advantageously, the beam access ports can consist of a first row of transmission ports disposed side by side along the focal axis of the lens and of a second row of reception ports disposed side by side along the focal axis of the lens, the first and the second rows being stacked one above the other, the transmission ports and the reception ports being distinct and of different sizes, each transmission port, respectively reception port, being furnished with a respective filter centred on the transmission, respectively reception, frequency band.

Advantageously, the linear radiating apertures of the various quasi-optical beamformers can be linked as an array to a single partially reflecting radome, common to all the quasi-optical beamformers, the radome comprising a first partially reflecting surface dimensioned for the reception frequency sub-band and a second partially reflecting surface dimensioned for the transmission frequency sub-band, the first and second partially reflecting surfaces being respectively disposed at the output of the linear radiating apertures, at a distance corresponding to a respective central wavelength of the two transmission and reception frequency sub-bands.

Advantageously, the hybrid beamformer can comprise a quasi-optical beamformer common to transmission Tx and to reception Rx, two distinct specific electronic beamformers, respectively dedicated to transmission and to reception, and switches comprising various positions respectively able to select a beam access port from among several, each switch selectively linking, according to its position, a phase and amplitude control chain of the electronic beamformer dedicated to transmission, respectively to reception, to one of the transmission ports, respectively reception ports, of each quasi-optical beamformer.

Advantageously, the beam access ports, selected by the switches in all the stacked quasi-optical beamformers and linked to one and the same electronic beamformer, can have an identical direction of orientation and cover an identical geographical sector.

Alternatively, a first part of the beam access ports selected by the switches in the stacked quasi-optical beamformers can cover a first geographical sector and a second part of the beam access ports selected by the switches in the stacked quasi-optical beamformers can cover a second geographical sector adjacent to the first geographical sector.

Advantageously, the combining device can consist of a combiner/divider comprising Nx inputs respectively linked to the Nx phase and amplitude control chains and a beam output.

Advantageously, the combining device can comprise a branch-off to split each phase and amplitude control chain into several different pathways, each pathway comprising a dedicated phase-shifter.

Advantageously, the combining device can consist of a quasi-optical beamformer based on PCB technology comprising Nx inputs respectively linked to the Nx phase and amplitude control chains and several beam outputs.

BRIEF DESCRIPTION OF THE DRAWINGS

Other particularities and advantages of the invention will be clearly apparent in the subsequent description given by way of purely illustrative and nonlimiting example, with reference to the appended schematic drawings which represent.

DETAILED DESCRIPTION

The novel active antenna architecture with reconfigurable beamforming according to the invention comprises a hybrid beamformer consisting of at least two planar quasi-optical beamformers stacked one above another, and of at least one planar electronic beamformer connected to a respective port of each planar quasi-optical beamformer. Each quasi-optical beamformer is able to form beams in a first direction in space parallel to the plane of the quasi-optical beamformer. The electronic beamformer is able to form the beams in a second direction in space, orthogonal to the first direction.

Figure 2:
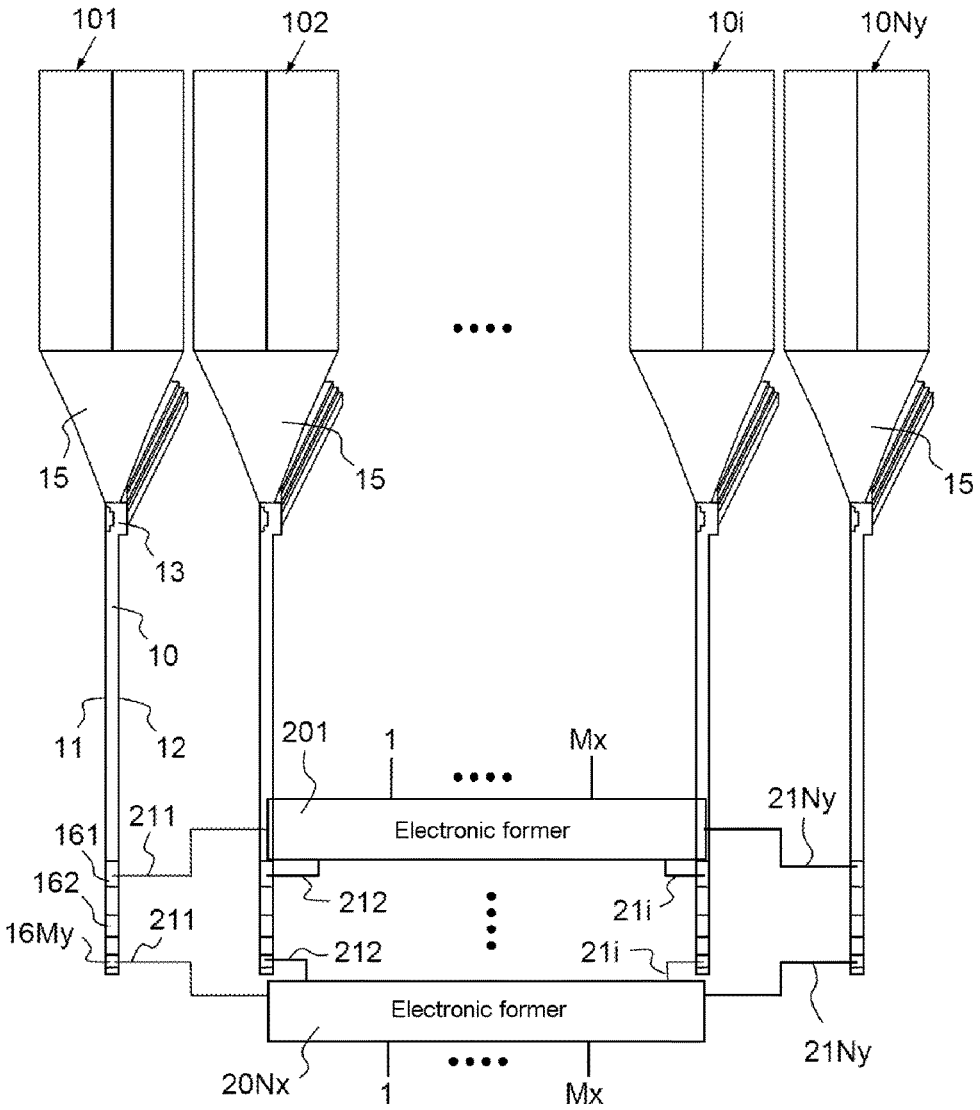
FIG. 2: a schematic diagram, in side view, of an exemplary multibeam hybrid beamformer, according to the invention.

In the example represented in FIG. 2, the hybrid beamformer comprises Ny quasi-optical beamformers 101, 102, . . . , 10*i*, . . . , 10Ny, stacked one above another, and Nx electronic beamformers 201, . . . , 20Nx, where Nx and Ny are integer numbers greater than one. For example, in FIG. 3, Ny is equal to four and in FIG. 5, Nx and Ny are equal to two.

Figure 1:
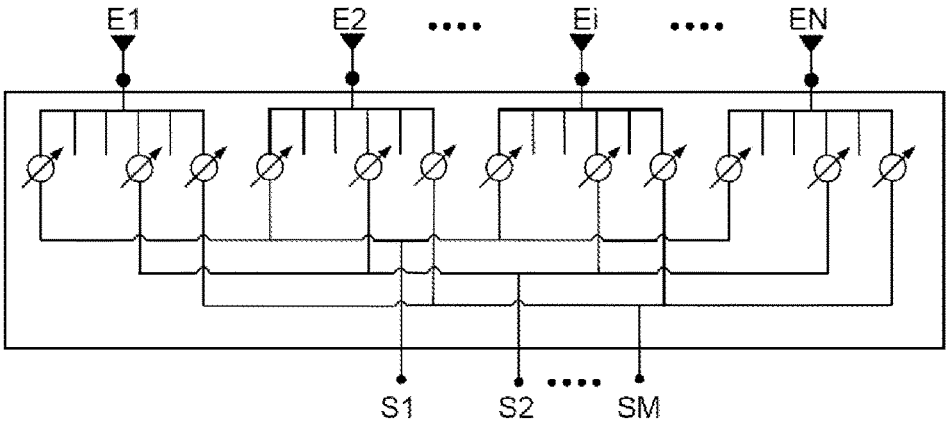
PRIOR ART FIG.1
FIG. 1: a schematic diagram of an exemplary electronic beamformer, according to the prior art.
Figure 3:
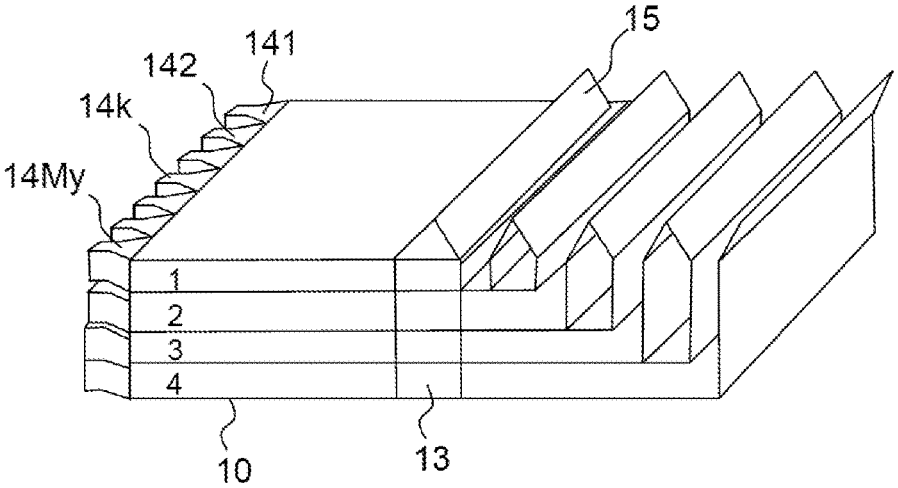
FIG. 3: a diagram, in perspective, of four stacked quasi-optical beamformers, according to the invention.
Figure 4:
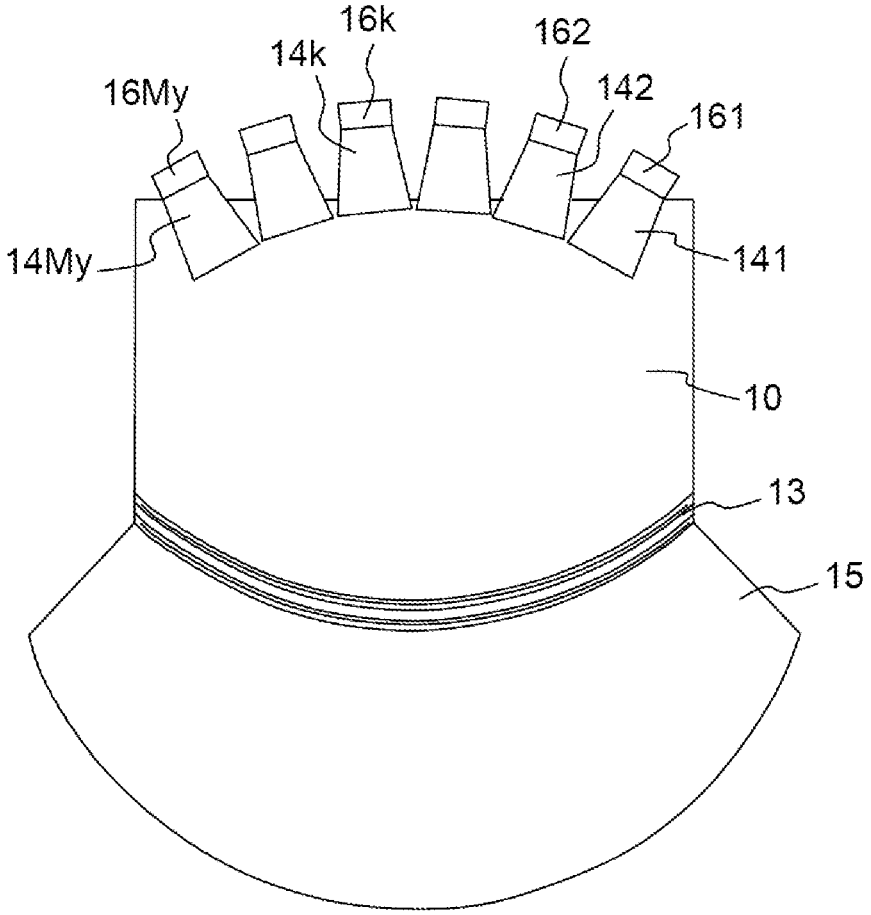
FIG. 4: a diagram, viewed from above, of a quasi-optical beamformer, according to the invention.

As represented in FIGS. 2, 3 and 4, each quasi-optical beamformer comprises a parallel-plate waveguide 10 (also known as a parallel guide plate) consisting of two parallel metal plates 11, 12, spaced apart, a lens 13 integrated into the waveguide 10, between the two metal plates, My internal horns 141, 142, . . . , 14*k*, . . . 14My, distributed periodically side by side along a focal axis of the lens 13, where My is greater than or equal to 2, My beam access ports 161, 162, . . . , 16*k*, . . . 16My, respectively associated with the My internal horns and connected to a first end of the waveguide 10, and a linear radiating aperture 15 designed at a second end of the waveguide 10. The linear radiating aperture 15 can be associated with a linear horn or with a radome which is common to all the quasi-optical beamformers of the hybrid beamformer. The quasi-optical beamformer makes it possible to focus, in the first direction in space, the signals received by the linear radiating aperture 15, on the My beam access ports 161, 162, . . . , 16*k*, . . . 16My, as a function of the direction of arrival of these received signals. The first direction in space is parallel to the plane of the metal plates 11, 12 of the waveguides of the quasi-optical beamformers. The lens 13 can be an optical lens distributed in a large part of the volume of the parallel-plate waveguide 10, such as for example of the Rotman lens type or of the index-gradient lens type, for example a Luneberg lens. Alternatively, the lens 13 can be a metallic delay-gradient lens localized in a limited zone of the parallel-plate waveguide as shown by for example the lens 13 illustrated in FIG. 2 and in FIG. 4, which extends transversely in a waveguide zone situated in front of the linear radiating aperture 15. The quasi-optical beamformer can furthermore comprise a focusing device, for example a parabolic reflector, integrated transversely into the waveguide 10, between the two parallel plates. In this case the quasi-optical beamformer has a structure conventionally called a pillbox.

Each electronic beamformer 201, . . . , 20Nx comprises Ny input ports respectively connected to the Ny quasi-optical beamformers 101, 102, . . . , 10*i*, . . . , 10Ny, each electronic beamformer 201, . . . , 20Nx comprising Mx outputs able to deliver Mx different beams, where Mx is greater than or equal to one. Each electronic beamformer 201, . . . , 20Nx is linked to a selected beam access port of each of the Ny quasi-optical beamformers and applies phase and amplitude control to the signals arising from the Ny corresponding beam access ports, and then electronically recombines the Ny signals delivered by the said beam access port of each of the Ny quasi-optical beamformers so as to form Mx beams in the second direction in space orthogonal to the first direction. To achieve the interconnection between each of the My beam access ports of the Ny quasi-optical beamformers and the Nx electronic beamformers, it is necessary for the number My of beam access ports of each quasi-optical beamformer to be equal to the number Nx of electronic beamformers. The electronic beamforming is reconfigurable by modification of the phase and amplitude law applied to each beam access port of the quasi-optical beamformers. The electronic beamformers allow reconfiguration, in the second direction in space, of the beams formed in the first direction by the quasi-optical beamformers.

With respect to a conventional electronic beamformer pertaining to an array of two-dimensional radiating elements, this hybrid beamforming makes it possible to considerably reduce the number of signals to which phase and amplitude control must be applied, since for each electronic beamformer, the phase and amplitude control pertains to only Ny beam access ports arising from each of the Ny quasi-optical beamformers instead of pertaining to Nx'*Ny' radiating elements of a two-dimensional array of radiating elements, where Nx' would be the number of radiating elements along a first axis X and Ny' would be the number of radiating elements along a second axis Y.

Figure 5:
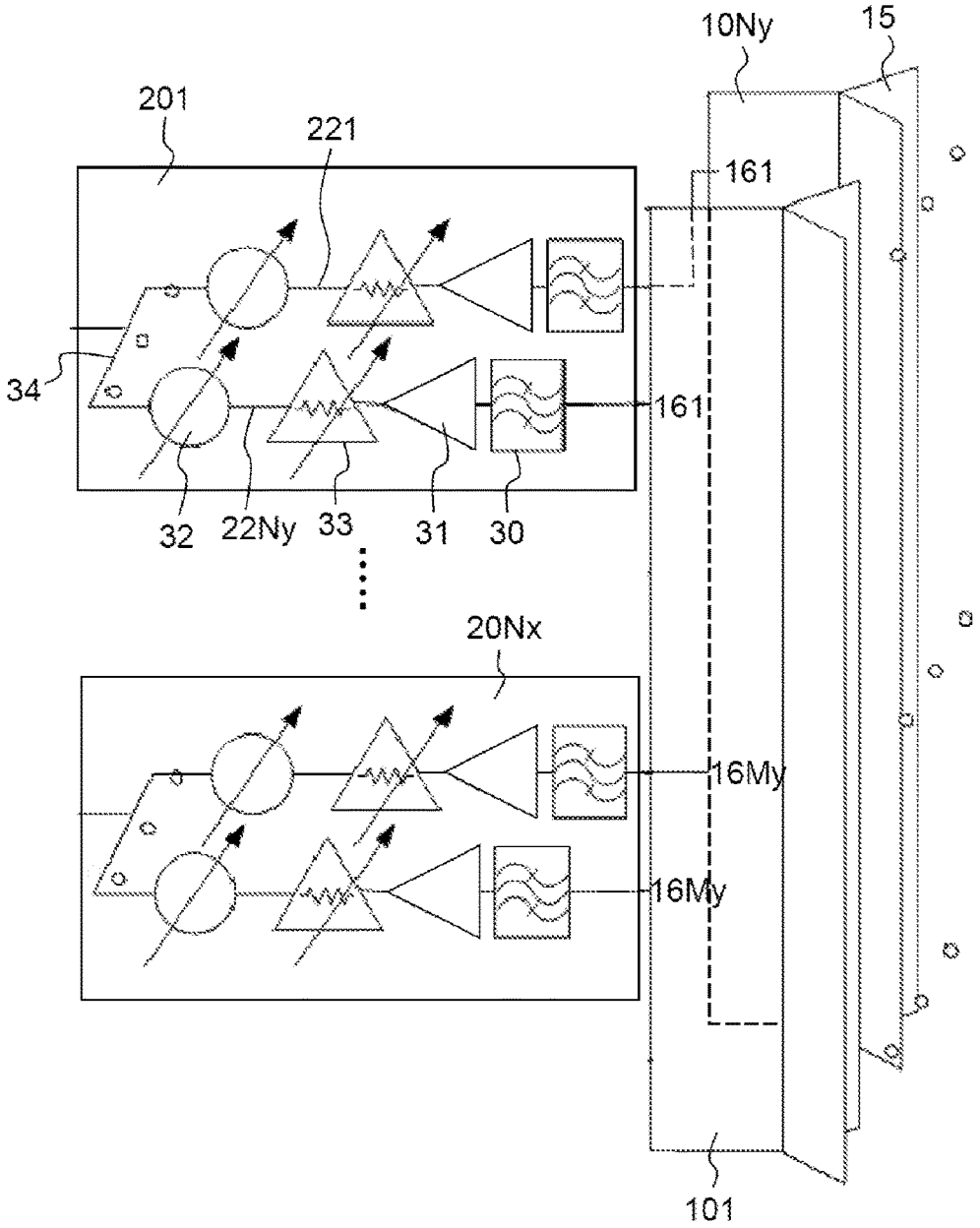
FIG. 5: a partial schematic diagram of an exemplary hybrid beamformer in which the functions of the electronic beamformers are detailed, according to the invention.

The example of FIG. 5 illustrates a simplified schematic diagram, for reception, of an exemplary hybrid beamformer in which only two quasi-optical beamformers and two electronic beamformers are represented and in which a single beam is delivered as output from each electronic beamformer. In this example, each electronic beamformer 201, . . . , 20Nx comprises a planar combining device 34, for example a combiner of chandelier type, able to operate, on reception, as a power combiner, and Ny phase and amplitude control chains 221, . . . , 22Ny respectively linked up to inputs of the combining device 34 so as to form the beams at the output of the combining device 34. The Ny phase and amplitude control chains 221, . . . , 22Ny of each electronic beamformer are respectively linked to a corresponding beam access port 161, . . . , 16Ny of each quasi-optical beamformer 101, . . . , 10Ny. This electronic beamformer is therefore particularly simple and achievable since it comprises only combinations of Ny signals delivered on Ny beam access ports of the Ny quasi-optical beamformers. Each phase and amplitude control chain 221, . . . , 22Ny comprises in series, a filter 30 connected to a beam access port 16*i*, . . . , 16Ny of a quasi-optical beamformer 101, . . . , 10Ny, an amplifier 31, as well as a variable attenuator 33 and a variable phase-shifter 32 making it possible to apply phase and amplitude control to the signals arising from the corresponding beam access port of each of the Ny quasi-optical beamformers. In FIG. 5, there is only a single beam formed at the output of the combining device 34, but, depending on the desired application, it is of course possible to form several beams by using more complex combining/dividing devices or quasi-optical beamformers based on SIW (Substrate Integrated Waveguide) technology produced in the form of printed circuits PCB (Printed Circuit Boards) such as illustrated for example in the embodiments of FIGS. 10 and 11 described further on.

Figure 6B:
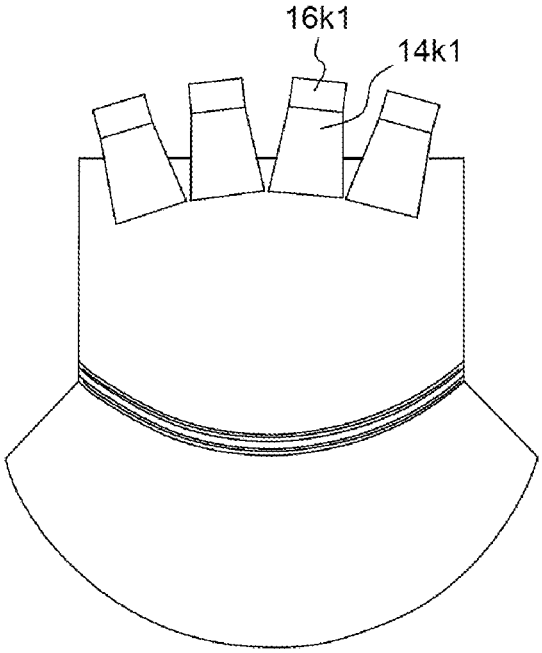
FIGS. 6*a*, 6*b*, 6*c*: three diagrams, respectively in longitudinal section, viewed from above and viewed from below, of a quasi-optical beamformer comprising ports dedicated to reception Rx and ports dedicated to transmission Tx, according to the invention.
Figure 6C:
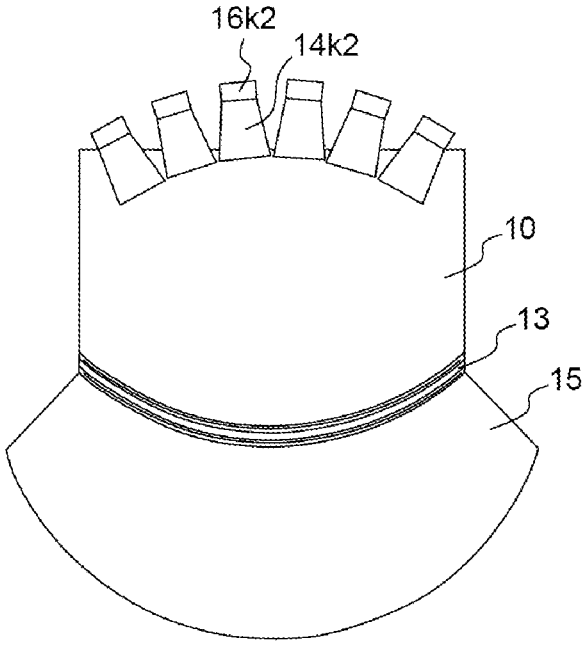
Figure 6A:
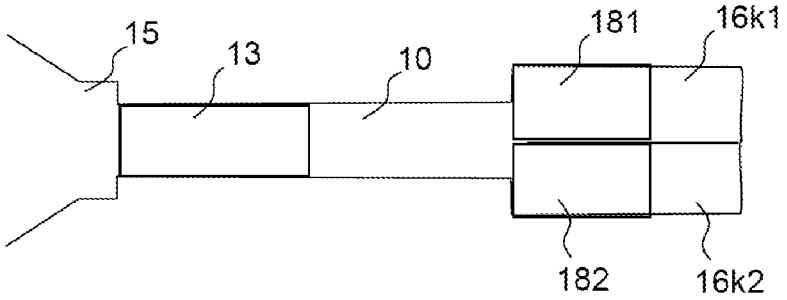

The quasi-optical beamformer exhibits the advantage of operating in a very broad frequency band since it propagates the TEM (Transverse Electro Magnetic) propagation mode which is non frequency dispersive. It can therefore be used to propagate signals in two very separate frequency sub-bands, such as for example transmission Tx and reception Rx bands in the Ka and Ku bands. In this case, to produce a transmission and reception antenna, the invention furthermore consists, within each quasi-optical beamformer, in designing distinct transmission Tx and reception Rx ports, respectively dedicated to transmission Tx and to reception Rx, and in furnishing each port Tx, Rx with respective filters respectively centred on the transmission and reception frequency bands so as to separate the transmission and reception signals. FIG. 6*a* represents an example of designing two ports for transmission 16*k*1 and reception 16*k*2 at the end of a waveguide 10 of a quasi-optical beamformer. In this FIG. 6*a*, the two ports Tx, Rx are furnished with corresponding filters 181, 182 and the waveguide is provided with a widened end making it possible to house the two ports Tx and Rx stacked one above the other. The two distinct ports Tx, Rx can be associated with distinct horns, internal to the quasi-optical beamformer. The physical size of the aperture of the internal horns is different for the two transmission and reception frequency sub-bands, so as to have one and the same dimension normalized by the central wavelength corresponding to each frequency sub-band. By way of nonlimiting example, for operation in the Ka band, in which the central reception frequency Rx is equal to 30 GHz and the central transmission frequency Tx is equal to 20 GHz, it is possible to dispose a first row of three reception horns 14*k*2 side by side along the focal axis of the lens of the quasi-optical beamformer and within the same bulk, to dispose a second row of two transmission horns 14*k*1 side by side along the focal axis of the lens of the quasi-optical beamformer, as shown by the two designs illustrated in FIG. 6*b*, the first and second rows being stacked inside the parallel-plate waveguide 10. In this configuration, the beams constructed on transmission Tx and on reception Rx intersect at the same level and there are 3/2 times as many reception beams Rx as transmission beams Tx over the same angular sector covered by the quasi-optical beamformer.

Figure 7:
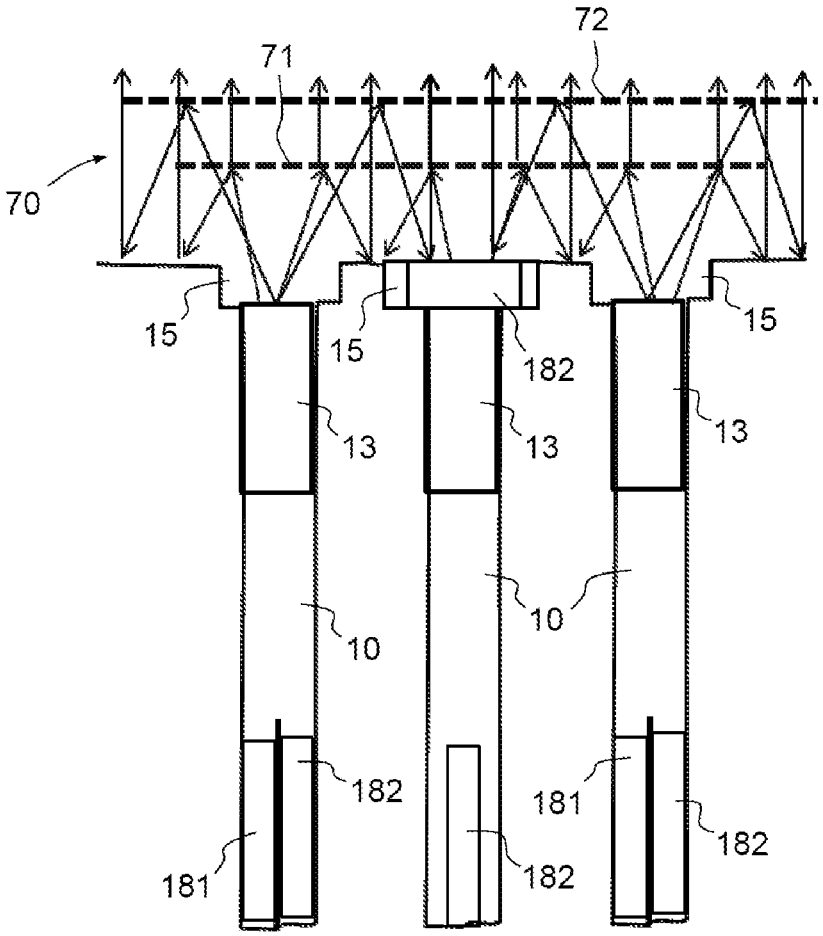
FIG. 7: a longitudinal sectional view, of an example of three stacked quasi-optical beamformers furnished with a common radome equipped with two partially reflecting surfaces, according to the invention.

When the transmission and reception frequency sub-bands are distantly separated, array lobes may occur during the electronic formation of the beams. This problem is due to the aperture width at the output of the linear horns of the quasi-optical beamformer, which must have an aperture whose maximum size corresponds to a fraction of the wavelength and which are therefore not suitable for operation in the two different frequency sub-bands Rx, Tx when they are very far apart. To dimension the linear radiating apertures of each quasi-optical beamformer in an optimal manner, the invention can consist furthermore, in removing the linear horns and in replacing them with a single partially reflecting radome, common to all the quasi-optical beamformers, and connected to all the linear radiating apertures of the quasi-optical beamformers, as is represented in the example of FIG. 7 which relates to the case of three quasi-optical beamformers set up as an array. In this FIG. 7, the radome 70 comprises a first partially reflecting surface 71 dimensioned for the reception frequency sub-band and a second partially reflecting surface 72 dimensioned for the transmission frequency sub-band. The two partially reflecting surfaces are respectively disposed at the output of the linear radiating apertures of the various quasi-optical beamformers, at a distance corresponding to the respective central wavelength of the two frequency sub-bands. The two reflecting surfaces distribute the radiofrequency signals, respectively for reception Rx and for transmission Tx. In order to obtain the same directivity in reception and in transmission, at the output of the two reflecting surfaces the radiating apertures are of different widths for the two frequency sub-bands Rx and Tx, the radiating aperture for transmission being larger than the radiating aperture for reception.

Furthermore, the architecture of the antenna can be different depending on whether it is operating in transmission or in reception. Notably, in the example of FIG. 7, only two quasi-optical beamformers out of three comprise two beam access ports equipped with respective filters 181, 182 and therefore operate in both sub-bands Rx, Tx. The intermediate quasi-optical beamformer comprises only a single beam access port equipped with a filter 182 dedicated to reception and therefore operates only in the sub-band Rx. This intermediate quasi-optical beamformer comprises a second filter 182 housed in the linear radiating aperture 15 so as to select, at the level of the corresponding linear radiating aperture, just the reception band.

Figure 8A:
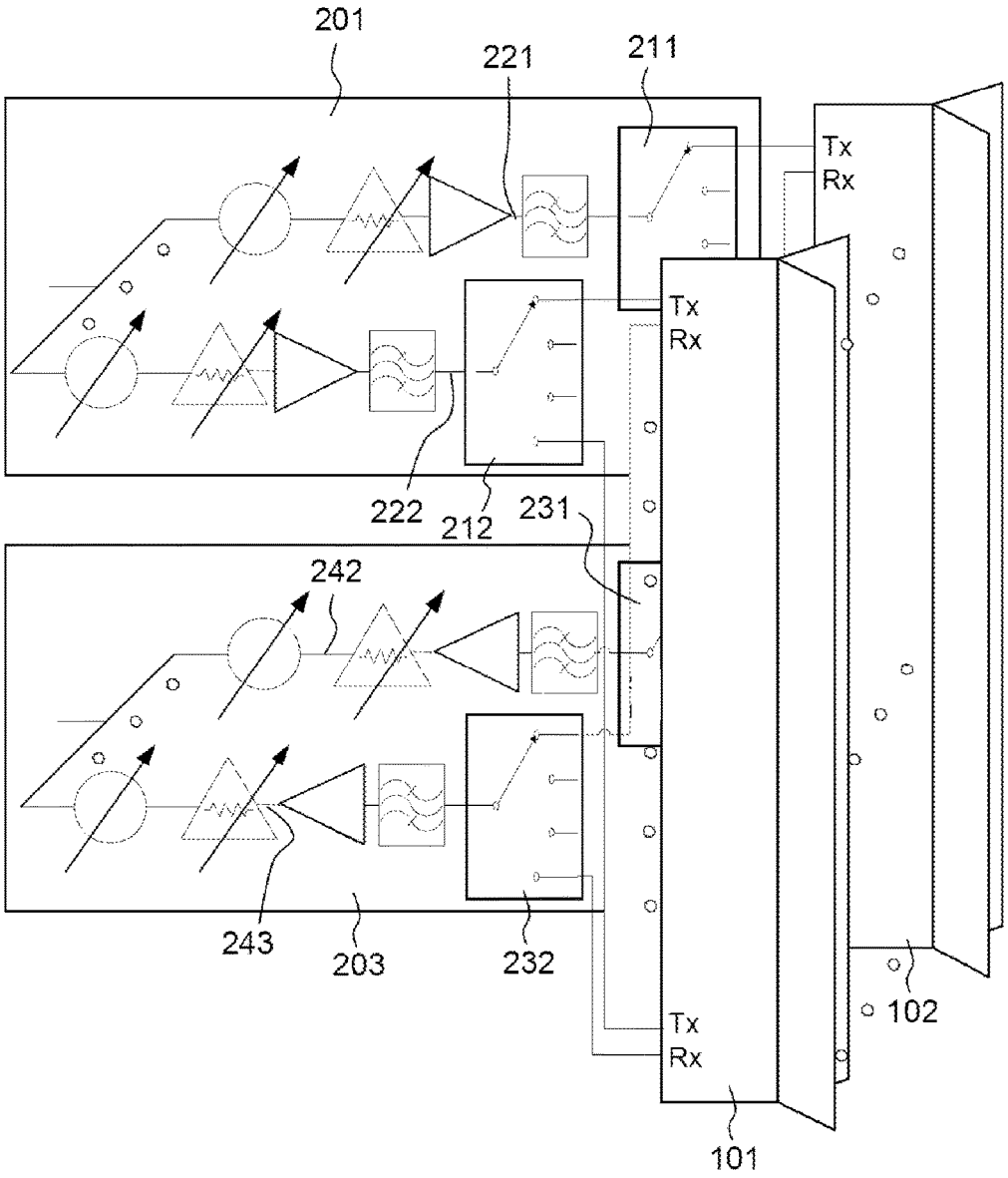
FIG. 8*a*: antenna architecture for a user terminal slaved to a satellite, able to form a transmission beam and a reception beam with selection of the direction of orientation of the beam, according to the invention.

Various applications are possible. The hybrid beamformer of the invention can be used in an antenna for a user terminal making it necessary to deliver a beam slaved to a satellite. To reduce the cost of this application, it is particularly beneficial that the antenna should operate in transmission Tx and in reception Rx. An exemplary architecture of such an antenna is represented in FIG. 8*a*. Only two quasi-optical beamformers 101, 102 are illustrated but there may be many more than two. In this example, the hybrid beamformer comprises at least two quasi-optical beamformers that are common to transmission Tx and to reception Rx, two distinct specific electronic beamformers, respectively dedicated to transmission 201, and to reception 203, and switches 211, 212, 231, 232 comprising various positions respectively able to select, according to their position, one beam access port from among several, the switches selectively linking the electronic beamformer 201, 203 dedicated to transmission, respectively to reception, to one of the transmission ports, respectively reception ports, of each quasi-optical beamformer 101, 102 of the hybrid beamformer. The quasi-optical beamformer, common to transmission Tx and to reception Rx, preforms the beams in the first direction in space, the two specific electronic beamformers 201, 203, respectively dedicated to transmission and to reception, form the beams in the second direction in space, orthogonal to the first direction. In FIG. 8*a*, each specific electronic beamformer 201, 203 comprises two phase and amplitude control chains 221, 222, 242, 243 respectively dedicated to the two quasi-optical beamformers 101, 102, each phase and amplitude control chain being selectively linked, by way of a switch with several positions 211, 212, 231, 232, to a chosen beam access port of the respective quasi-optical beamformer. Each switch comprises an input connected to a phase and amplitude control chain of an electronic beamformer and several outputs respectively connected to various respective ports of the various internal horns of a corresponding quasi-optical beamformer.

The beams preformed by the quasi-optical beamformer and delivered on the various beam access ports of the quasi-optical beamformer have mutually different directions of orientation. Consequently, the direction of pointing of the beam produced by the hybrid beamformer can be chosen, depending on the position of the switch, by selecting a port of the quasi-optical beamformer from among several.

Figure 8B:
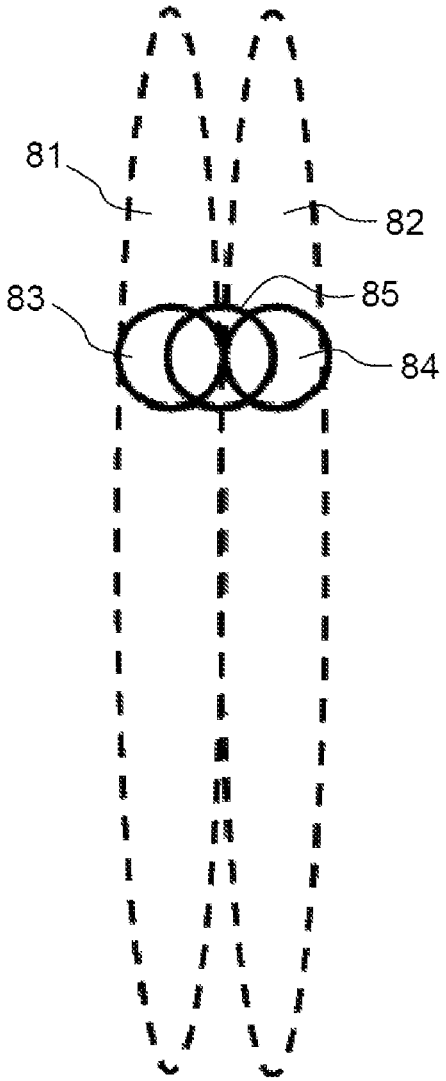
FIG. 8*b*: an example of beams formed by the hybrid beamformer, in the case of the selection, in two adjacent quasi-optical beamformers, of beam access ports covering adjacent geographical sectors, according to the invention.

The access ports, selected by the switches in all the quasi-optical beamformers stacked and linked to one and the same electronic beamformer, can have an identical direction of orientation and cover an identical geographical sector. In this case, the hybrid beamformer points in the geographical sector covered by the corresponding access ports of each quasi-optical beamformer. As, for each quasi-optical beamformer, the geographical sectors covered by two adjacent access ports intersect with attenuations that may reach between 3 dB and 6 dB, the hybrid beamformer will then also exhibit an attenuation of one and the same order of magnitude in the two corresponding directions. To improve the gain of the antenna including the hybrid beamformer, it is possible to point a beam in an intermediate direction situated between two adjacent geographical sectors. Accordingly, the invention consists in alternating the access ports selected in various successive quasi-optical beamformers so that a first part of the selected access ports covers a first geographical sector and a second part of the selected access ports covers a second geographical sector, adjacent to the first geographical sector. The number of access ports selected in each of the two adjacent geographical sectors depends on the intermediate pointing direction desired for the corresponding beam. FIG. 8*b* illustrates an example of intermediate pointing of the beam situated between two adjacent beams. In this FIG. 8*b*, the two ellipses 81, 82 represented dashed represent the two beams produced in a first direction in space, by two adjacent quasi-optical beamformers and the three solid circles 83, 84, 85 represent the beams delivered at the output of the hybrid beamformer, after electronic beamforming in the second direction in space, orthogonal to the first direction. Each of the two outer circles 83, 84 is obtained by selecting, for the two quasi-optical beamformers, the access ports covering a first geographical sector, respectively a second geographical sector adjacent to the first geographical sector. The two outer circles therefore correspond to two adjacent geographical sectors. The intermediate circle 85 situated between the two outer circles 83, 84 is obtained by selecting, for a first half, the access ports covering the first geographical sector and, for a second half, the access ports covering the second geographical sector adjacent to the first geographical sector.

Furthermore, in the case where significant squinting is desired, to this squinting of the beam by selecting the ports of the quasi-optical beamformer, may be added a mechanical squinting of the quasi-optical beamformer so as to position the quasi-optical beamformer in the proper direction and to thus reduce the complexity of the electronic beamforming.

Figure 9:
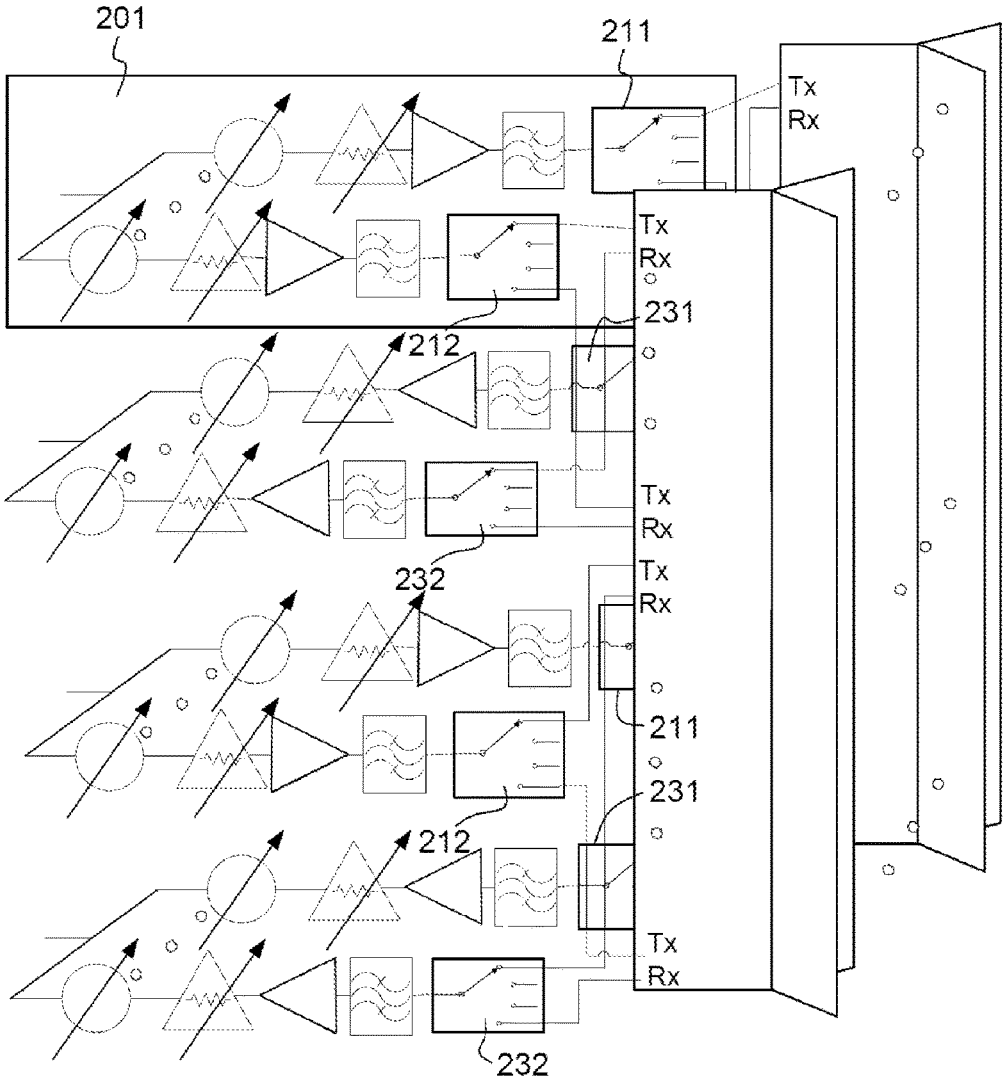
FIG. 9: transmission and reception multibeam antenna architecture with selection of the direction of orientation of the beams, in the case where the beams cover a predetermined geographical sector, according to the invention.

The hybrid beamformer of the invention can also be used in a multibeam transmission and reception antenna as represented in the exemplary antenna of FIG. 9 in the case where the spots cover a predetermined geographical sector. In this example, the quasi-optical beamformers are identical to that described in conjunction with FIG. 8*a*. Only the number of specific electronic beamformers dedicated to transmission and to reception is increased as a function of the number of beams to be constructed. In FIG. 9, two beams are constructed on transmission and two beams are constructed on reception. For each beam to be constructed, if the quasi-optical beamformer comprises Ny stages, with Ny equal to two in the example of FIG. 8*a*, the electronic beamformer comprises Ny phase and amplitude control chains, each phase and amplitude control chain dedicated to transmission, respectively to reception, being selectively linked, by way of a switch with several different positions, for example four positions in FIG. 9, to a chosen port of a respective quasi-optical beamformer, the ports that may be selected on transmission, respectively on reception, by a first switch being different from the ports that may be selected on transmission, respectively on reception, by a second switch. In the case of an application for which it is necessary to carry out any pointing on the basis of any of the ports of the quasi-optical beamformer, the selecting of the ports will be more significant and the switches will be much more complex. The more complex the selecting of the ports, the more power losses there are. To mask the power losses, it is then possible to add amplifiers distributed between the switches of the quasi-optical beamformer.

Figure 10:
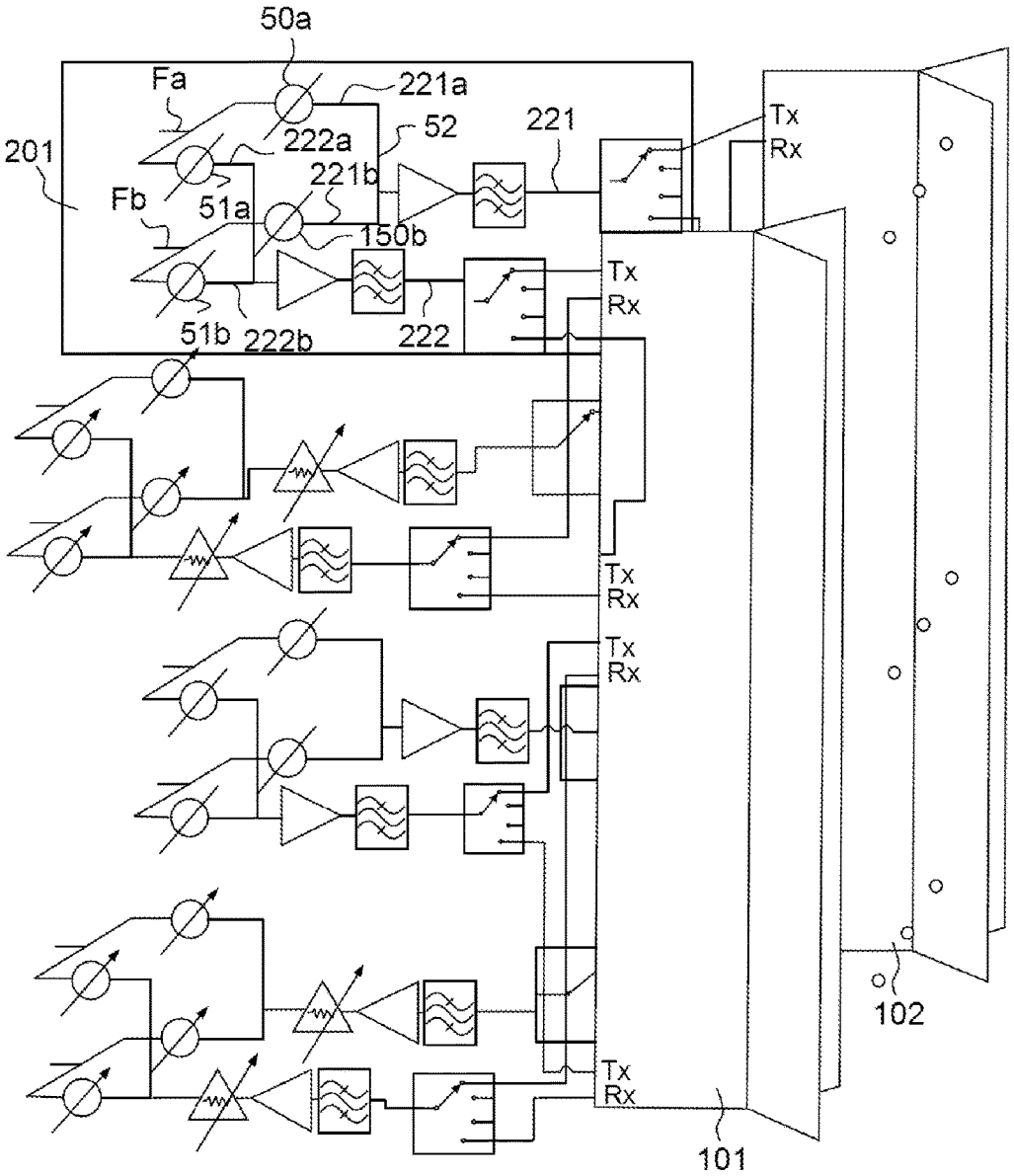
FIG. 10: transmission and reception multibeam antenna architecture with selection of the direction of orientation of the beams, in the case where each electronic beamformer comprises several different phase-shift pathways, according to the invention.

In another application to a multibeam antenna mounted aboard a satellite of a constellation of satellites travelling in low or medium orbit, it is necessary to be able to carry out any pointing of the antenna on the basis of any of the beam access ports of the quasi-optical beamformers. In this case, several beams must be formed as output from each electronic beamformer. Accordingly, as represented for example in FIG. 10, each phase and amplitude control chain 221, 222 connected to the quasi-optical beamformers can comprise a branch-off 52 to split the phase and amplitude control chain into several different pathways 221*a*, 221*b*, 222*a*, 222*b*, each pathway comprising a dedicated phase-shifter 50*a*, 50*b*, 51*a*, 51*b*. This makes it possible to allocate various phase shifts to each beam access port of a quasi-optical beamformer. At the output of the phase-shifters, a power combiner/divider recombines the pathways so as to deliver several different beams Fa, Fb corresponding to different phase laws. In the example of FIG. 10, two beams are delivered as output from each electronic beamformer, but of course this is not limiting; by using a number greater than two of pathways, it is possible to form a number greater than two of beams.

Figure 11:
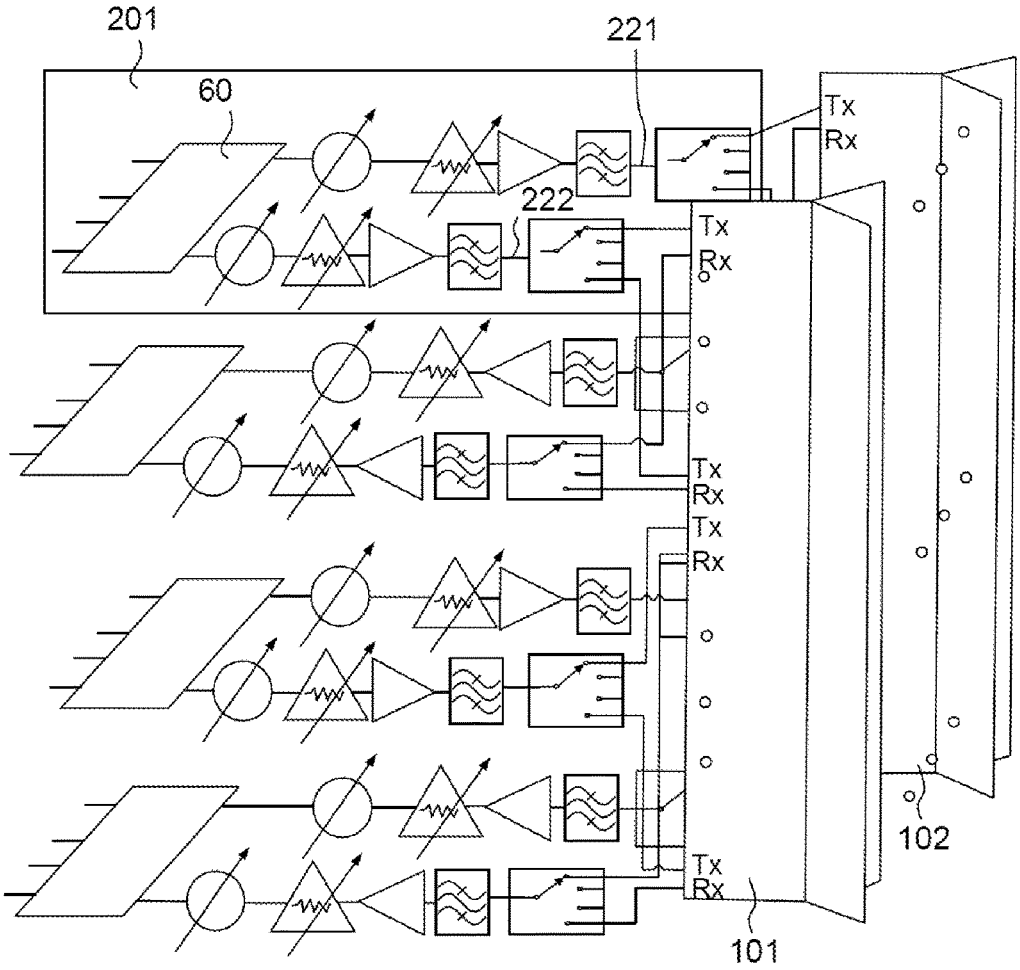
FIG. 11: transmission and reception multibeam antenna architecture with selection of the direction of orientation of the beams, in the case where each electronic beamformer comprises a quasi-optical beamformer based on PCB technology, according to the invention.

Alternatively, as represented in FIG. 11, to produce multiple beams as output from each electronic beamformer, each electronic beamformer can include a quasi-optical former 60 based on PCB technology comprising several beam outputs corresponding to different phase shifts and several inputs to which the active chains 221, 222 are linked. The quasi-optical beamformer based on PCB technology is then used in place of the signal combiner/divider represented in FIG. 8.

In the two embodiments represented in FIGS. 10 and 11, the beams thus obtained are then tilted solely as a function of the phase shift applied to each pathway. In the case of FIG. 10, the beams formed are mutually independent, and can be pointed in arbitrary directions. In the case of FIG. 11, a cluster of beams is produced, and this cluster is steerable and the beams are not mutually independent.

The quasi-optical beamformers can be mounted with their longitudinal axis oriented parallel to the axis orthogonal to the travel of the satellite so as to preform a row of beams according to this orthogonal axis and to recombine the ports of these quasi-optical beamformers with the electronic beamformer. This makes it possible to follow one and the same geographical zone on the ground as the satellite is travelling and also makes it possible to squint the assembly of the beams formed along the axis of travel when the satellite is travelling above a zone with low traffic, such as the oceans.

Although the invention has been described in conjunction with particular embodiments, it is quite obvious that it is in no way limited thereto and that it comprises all the technical equivalents of the means described as well as their combinations if the latter enter within the framework of the invention.

The invention claimed is:

1. An active antenna architecture with reconfigurable beamforming, comprising a hybrid beamformer comprising:

Ny stacked planar quasi-optical beamformers, where Ny is an integer number greater than one, each quasi-optical beamformer comprising a parallel-plate waveguide having two ends respectively furnished with a linear radiating aperture and with My beam access ports, a lens integrated into the parallel-plate waveguide, internal horns distributed periodically side by side along a focal axis of the lens, the beam access ports being respectively associated with the internal horns, each quasi-optical beamformer forming beams in two separate frequency bands, respectively for transmission and for reception, in a first direction in space parallel to the plane of the parallel-plate waveguides, and at least one planar electronic beamformer comprising Ny phase and amplitude control chains and a combining device comprising Ny inputs respectively linked to the Ny phase and amplitude control chains and at least one beam output, each phase and amplitude control chain being connected to a respective beam access port of each quasi-optical beamformer, the electronic beamformer forming beams in a second direction in space, orthogonal to the first direction.

2. The antenna architecture according to claim 1, further comprising switches for selecting, in each quasi-optical beamformer, a port from among all the available beam access ports, each switch comprising an input connected to a phase and amplitude control chain of the electronic beamformer and several outputs respectively connected to several respective beam access ports of the corresponding quasi-optical beamformer.

3. The antenna architecture according to claim 2, wherein the beam access ports consist of a first row of transmission ports disposed side by side along the focal axis of the lens and of a second row of reception ports disposed side by side along the focal axis of the lens, the first and the second rows being stacked one above the other, the transmission ports and the reception ports having different sizes, each transmission port, respectively reception port, being furnished with a respective filter centred on the transmission, respectively reception, frequency band.

4. The antenna architecture according to claim 2, wherein the linear radiating apertures of the various quasi-optical beamformers are linked as an array to a single partially reflecting radome, common to all the quasi-optical beamformers, the radome comprising a first partially reflecting surface dimensioned for the reception frequency sub-band and a second partially reflecting surface dimensioned for the transmission frequency sub-band, the first and second partially reflecting surfaces being respectively disposed at the output of the linear radiating apertures, at a distance corresponding to a respective central wavelength of the two transmission and reception frequency sub-bands.

5. The antenna architecture according to claim 3, wherein the hybrid beamformer comprises a quasi-optical beamformer common to transmission Tx and to reception Rx, two distinct specific electronic beamformers, respectively dedicated to transmission and to reception, and switches comprising various positions respectively able to select a beam access port from among several, each switch selectively linking, according to its position, a phase and amplitude control chain of the electronic beamformer dedicated to transmission, respectively to reception, to one of the transmission ports, respectively reception ports, of each quasi-optical beamformer.

6. The antenna architecture according to claim 4, wherein the hybrid beamformer comprises a quasi-optical beamformer common to transmission Tx and to reception Rx, two distinct specific electronic beamformers, respectively dedicated to transmission and to reception, and switches comprising various positions respectively able to select a beam access port from among several, each switch selectively linking, according to its position, a phase and amplitude control chain of the electronic beamformer dedicated to transmission, respectively to reception, to one of the transmission ports, respectively reception ports, of each quasi-optical beamformer.

7. The antenna architecture according to claim 5, wherein the beam access ports, selected by the switches in all the stacked quasi-optical beamformers and linked to one and the same electronic beamformer, have an identical direction of orientation and cover an identical geographical sector.

8. The antenna architecture according to claim 5, wherein a first part of the beam access ports selected by the switches in the stacked quasi-optical beamformers covers a first geographical sector and a second part of the beam access ports selected by the switches in the stacked quasi-optical beamformers covers a second geographical sector adjacent to the first geographical sector.

9. The antenna architecture according to claim 1, wherein the combining device consists of a combiner/divider comprising Nx inputs respectively linked to the Nx phase and amplitude control chains and a beam output.

10. The antenna architecture according to claim 1, wherein the combining device comprises a branch-off to split each phase and amplitude control chain into several different pathways, each pathway comprising a dedicated phase-shifter.

11. The antenna architecture according to claim 1, wherein the combining device consists of a quasi-optical beamformer based on PCB technology comprising Nx inputs respectively linked to the Nx phase and amplitude control chains and several beam outputs.

* * * * *